US011401772B2

(12) United States Patent
Fripp et al.

(10) Patent No.: US 11,401,772 B2
(45) Date of Patent: Aug. 2, 2022

(54) DOWNHOLE BARRIER DEVICE HAVING A BARRIER HOUSING AND AN INTEGRALLY FORMED RUPTURE SECTION

(71) Applicant: Halliburton Energy Services, Inc., Houston, TX (US)

(72) Inventors: Michael Linley Fripp, Carrollton, TX (US); Stephen Michael Greci, Little Elm, TX (US); Richard Decena Ornelaz, Frisco, TX (US); Celso Max Trujillo, Jr., Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 74 days.

(21) Appl. No.: 16/771,198

(22) PCT Filed: Sep. 5, 2019

(86) PCT No.: PCT/US2019/049660

§ 371 (c)(1),
(2) Date: Jun. 9, 2020

(87) PCT Pub. No.: WO2021/045758

PCT Pub. Date: Mar. 11, 2021

(65) Prior Publication Data

US 2021/0071492 A1 Mar. 11, 2021

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 23/06; E21B 34/063
See application file for complete search history.

(56) References Cited

U.S. PATENT DOCUMENTS

2011/0284242 A1* 11/2011 Frazier ..... E21B 34/063 166/376
2011/0284243 A1* 11/2011 Frazier ..... E21B 34/063 166/376

(Continued)

FOREIGN PATENT DOCUMENTS

CN 101675210 A * 3/2010 ..... F16K 17/162
CN 110374552 A * 10/2019

(Continued)

OTHER PUBLICATIONS

Written Opinion for PCT/US19/49660, dated Mar. 11, 2021.*

(Continued)

*Primary Examiner* — Steven A MacDonald
(74) *Attorney, Agent, or Firm* — McGuireWoods LLP

(57) ABSTRACT

A downhole barrier device comprising a housing having a design and a rupture layer formed with the housing and having another design. The housing and rupture layer are integrally formed using a laser melting process and have a density greater than 98 percent. The laser melting process is performed using a 3D printing process. The other design can be selected from a plurality of designs including at least two of: at least one fabricated stress concentration; at least one pattern of thickness less that of a thickness of the design; a sealing layer, a support layer, and a flow hole; and at least one shape selectable selected from a disc shape, a pinched shape, a folded shape, and a curved shape. The downhole barrier device can be formed using a metal selected from a plurality of metals and be selected based on operational use of the downhole barrier device.

20 Claims, 5 Drawing Sheets

(56) References Cited

U.S. PATENT DOCUMENTS

| | | | | |
|---|---|---|---|---|
| 2014/0083716 | A1* | 3/2014 | Frazier | E21B 34/10 166/376 |
| 2014/0174757 | A1 | 6/2014 | Fripp et al. | |
| 2014/0216756 | A1* | 8/2014 | Getzlaf | E21B 33/146 166/376 |
| 2014/0338923 | A1 | 11/2014 | Fripp et al. | |
| 2015/0068730 | A1* | 3/2015 | Frazier | E21B 34/063 166/181 |
| 2016/0175932 | A1 | 6/2016 | Dimter et al. | |
| 2018/0161163 | A1 | 6/2018 | Macke et al. | |
| 2018/0202260 | A1 | 7/2018 | Getzlaf et al. | |
| 2019/0032451 | A1* | 1/2019 | Passmore | B33Y 80/00 |
| 2019/0078416 | A1* | 3/2019 | Vick, Jr. | E21B 33/129 |
| 2020/0009666 | A1* | 1/2020 | Krebill | B23K 26/359 |

FOREIGN PATENT DOCUMENTS

| | | | | |
|---|---|---|---|---|
| WO | WO-2016037281 A | * | 3/2016 | E21B 33/12 |
| WO | 2017160266 | | 9/2017 | |
| WO | 2018194560 | | 10/2018 | |

OTHER PUBLICATIONS

International Search Report and Written Opinion for corresponding International Application No. PCT/US2019/049660, dated Jun. 19, 2020.

* cited by examiner

DOWNHOLE BARRIER DEVICE HAVING A BARRIER HOUSING AND AN INTEGRALLY FORMED RUPTURE SECTION

BACKGROUND

Downhole barrier devices are commonly used in the oil field industry. They can be used to separate wellbore sections so that downhole operations can be performed. After the operations are performed, pressure can be applied to a section of the barrier device called a rupture disc so that an attached tool can be activated, e.g. a packer or a shift sleeve. Traditionally, downhole barrier devices used in downhole wellbore service operations include a barrier casing and the rupture disc wherein the two are physically coupled, e.g. using gaskets and threading one to the other, at some point during a service operation. Because the barrier device consists of separate manufactured pieces using a threaded nut/bolt type design and gasket, they are inherently leaky or can be leaky, especially in downhole well environments. Coupling the separate pieces in this manner can be very difficult, especially when performed downhole, and can create hazardous downhole conditions and be potentially fatal for those performing well site operations. Additionally, the separate manufacture of the barrier casing and the rupture disc often results in the use of different manufacturing materials. The use of different combinations in downhole operations can create galvanic reactions with other downhole parts, potentially creating maintenance issues and other safety issues.

Furthermore, rupture discs are typically manufactured by rolling metal and cutting from the sheets the rupture disc by either stamping or laser welding. An issue with these methods is that rolled metal does not always rupture at a specified pressure reliably, because stamping and welding both alter the compositional characteristics of the metal. Another issue is that due to the limited design or configurations options of rolling metal, the disc often ruptures in ways that can produce pieces that may affect operation of downhole tools, such as a valve, or simply create an obstruction in a pathway. In essence, the separate manufacture of the rupture discs introduces additional costs, complexity, quality/reliability issues, and limited design options.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

Presented herein is a disclosure of a downhole barrier device, or isolation device, that includes an integrally formed housing section and a rupture layer. The section and layer are integrally formed using a selective laser melting process. The rupture layer can be formed into many different design configurations and formed to have different stress concentrations along its surface. The rupture layer can be formed to have a reliable tensile stress, e.g. to burst reliably between a minimum and maximum pressure. In addition, the barrier device can be formed to have a porosity less than 2 percent and efficiently and cost effectively formed using a common metal chosen from a plurality of metals, e.g. a metal consistent with other downhole tools. In addition, the laser melting process can be performed using a reliable, cost effective 3D printing process.

Figure 1:
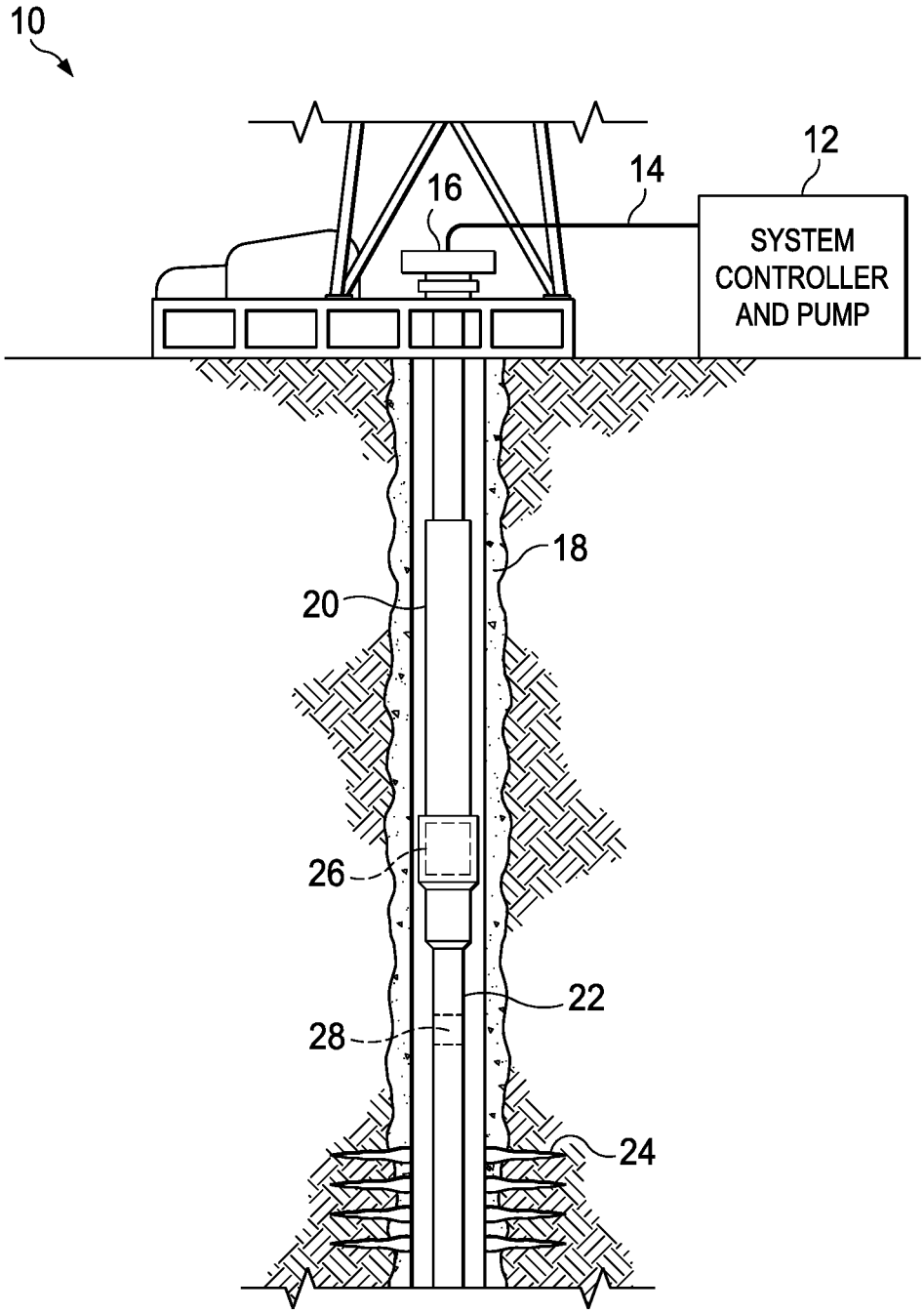
FIG. 1 is an illustration of a diagram of a well site where a barrier device is used in wellbore operations, in accordance with certain example embodiments.

Referring now to FIG. 1, illustrated is a diagram of a well site where a barrier device is used in wellbore operations, in accordance with certain example embodiments, denoted generally as 10. The well site 10 includes a system controller and pump 12, a coupling joint or running line 14, a well head 16, well casing 18, tubing section 20, 22, perforations 24 formed in the well casing 18, a barrier device 26, and a downhole tool 28, such as a packer. The barrier device 26 functions to separate the sections, temporarily, so that work can be performed in one section safely without damaging the downhole tool 28 or component parts thereof and prevent the downhole tool form negatively interacting with the section being worked on. Once the necessary operations are completed, a force of pressure, e.g. from pumping fluid into the ID of the well casing 18 or running a tool downhole, applied to a rupture layer of barrier device 26 breaks ruptures the rupture layer. Once the rupture layer is broken, the downhole tool 28 can then be activate, e.g., in the case of the packer, to create a permanent seal.

Referring now to FIGS. 2A-2L, illustrated are various rupture layer and barrier housing designs of the barrier device 26, in accordance with certain example embodiments, denoted in general as 30 and 32, respectively, and specifically as an alphanumeric combination according to the figure. The designs are based on a multitude of factors that can include wellbore operation requirements, such as the Internal Diameter (ID) of the wellbore casing, available force, the particular wellbore operation, and the metal used to design the barrier device 26. There may be a need the rupture layer shatters into several small pieces thereby significantly reducing the chance of affecting operation of other downhole tools, such as a valve, or blocking a passageway. Alternatively, there may only be a need to have the rupture layer shred in places along the surface so that pieces of a punctured rupture layer remains fixed to the barrier housing design.

In FIGS. 2A-2E, the housing designs 32 and the rupture layer designs 30 are based on varying the thickness along radial and diametric sections of the barrier device 26. Rupture layer 30*a* and housing 32*b* of FIG. 2A include a thin middle section and thick outer section, respectively. In essence, the barrier device 26 includes an inner circumferential surface, i.e. rupture layer 30*a*, and an outer ring with the inner circumferential surface having a thickness less than that of the outer ring, housing 32*b*, and capable of rupturing under predetermined amount of pressure or a pressure range. The rupture layer 30*a* is designed to puncture and shred under the predetermined amount of pressure or pressure range.

Figure 2A:
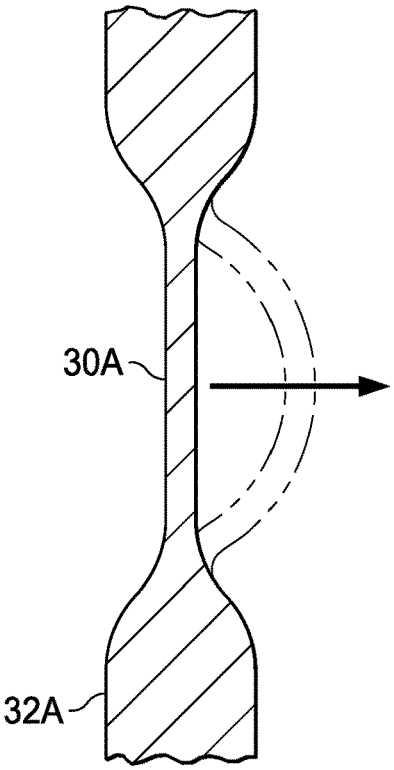
FIGS. 2A-2L are illustrations of various rupture layer designs for the barrier device, in accordance with certain example embodiments.
Figure 2B:
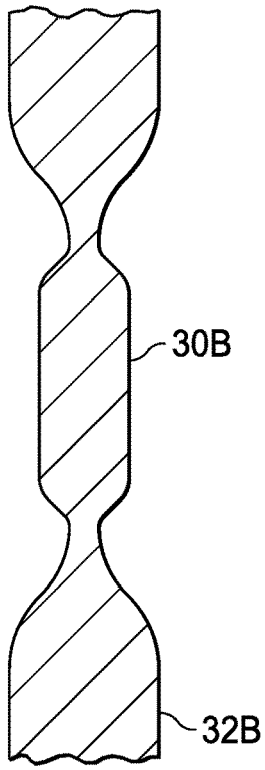
Figure 2C:
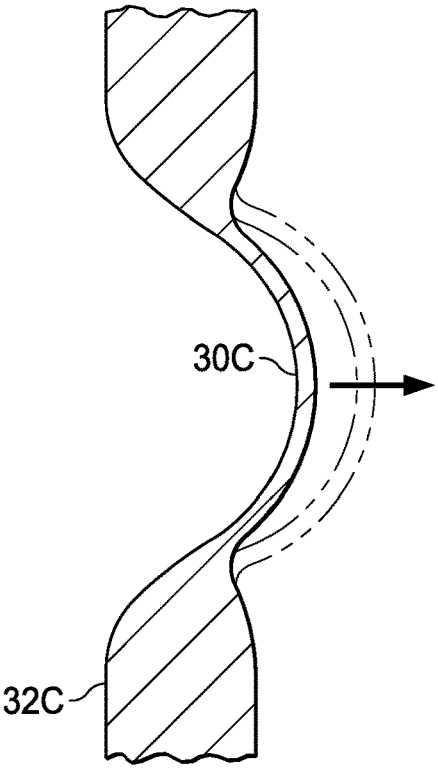
Figure 2D:
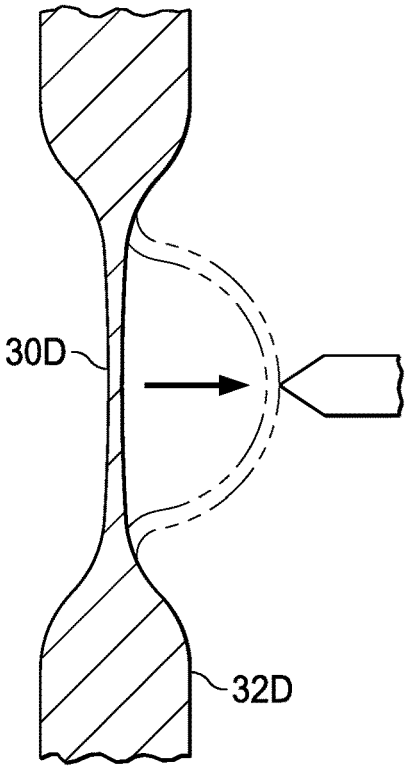
Figure 2E:
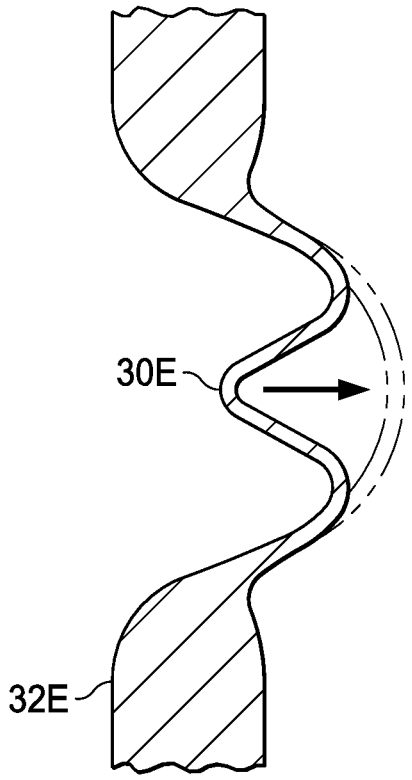

FIG. 2B includes a pinched designed where a ring of less thickness than housing 32*b* is formed in the barrier device 26 that would allow rupture layer 30*b* to break away from housing 32*b*. In FIG. 2C, a disc similar to that of FIG. 2A is formed in the barrier device 26 but includes an impression that would allow rupture layer 30*c* to rupture under less pressure than that of rupture layer 30*a*. In FIG. 2D, a pin shaped instrument is used to create a pressure point, or pressure concentration, on rupture layer 30*d* experiencing pressure from an opposite direction to cause rupture layer 30*d* to rupture. In essence, pressure applied to rupture layer 30*d*, e.g. using a high pressure fluid flow, forces rupture layer 30 into the pin shaped instrument which causes the pressure concentration. The pen shaped device can be fixed to the barrier housing or some other downhole tool. In FIG. 2E, a disc with impressions is formed in the barrier device 26. The shape of this impression creates stress concentrations, which allows rupture layer 30*e* to rupture under less pressure.

Figure 2F:
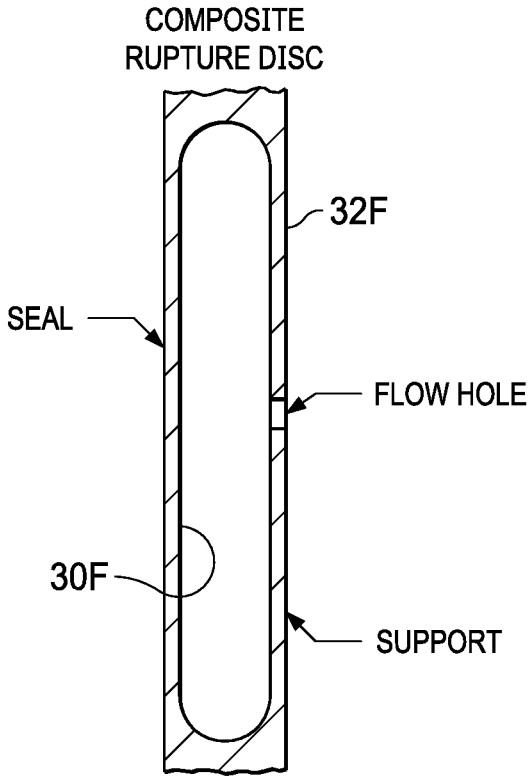

In FIG. 2F the barrier device 26 is designed to rupture at different pressures or pressure ranges depending on the direction of pressure applied to housing 32*f*. Rupture layer 30*f* is formed in the shape of a hollow disc formed within housing 32*f*. The barrier device 26 includes a flow hole integrated with housing 32*f* and rupture layer 30*f* that allows an applied force having a certain pressure or range of pressures to be concentrated on rupture layer 30*f* and, therefore, cause housing 32*f* and rupture layer 30*f* to burst at a much lower pressure than a force applied in the opposite direction. In the opposite direction the pressure from the applied force is not concentration and, therefore, the amount of force required to rupture housing 32*f* and rupture layer 30*f* is higher.

Figure 2G:
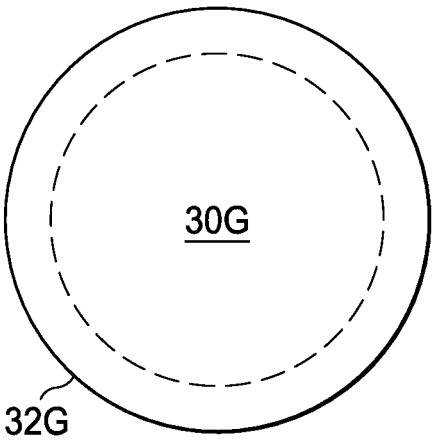
Figure 2H:
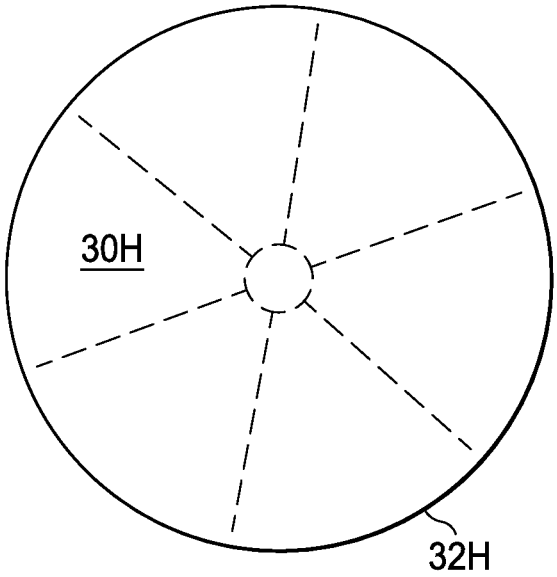
Figure 2I:
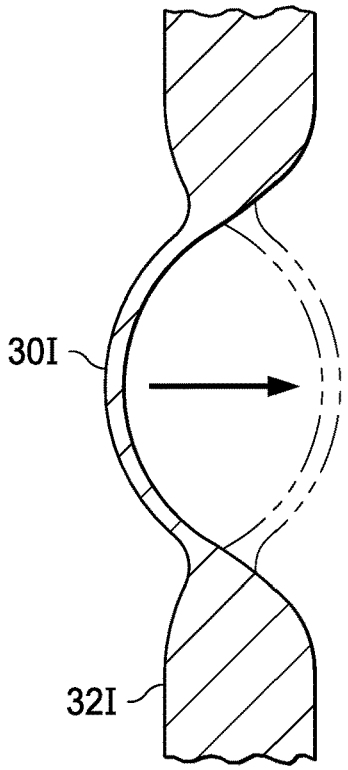
Figure 2J:
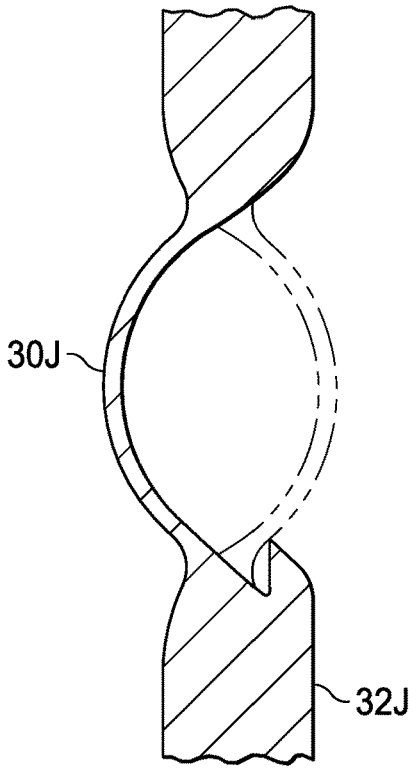
Figure 2K:
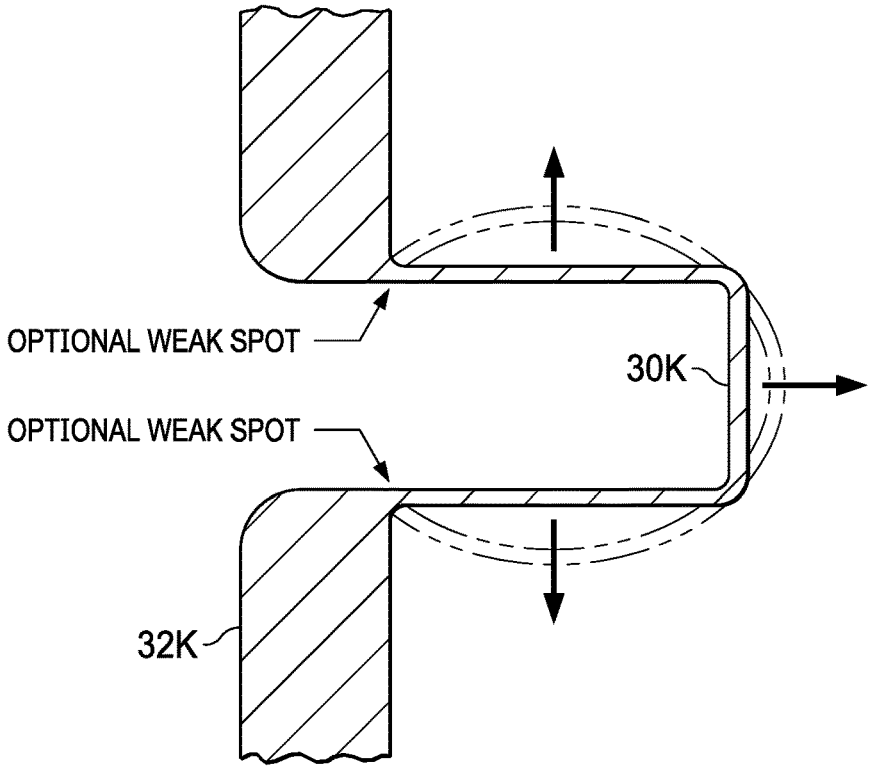
Figure 2L:
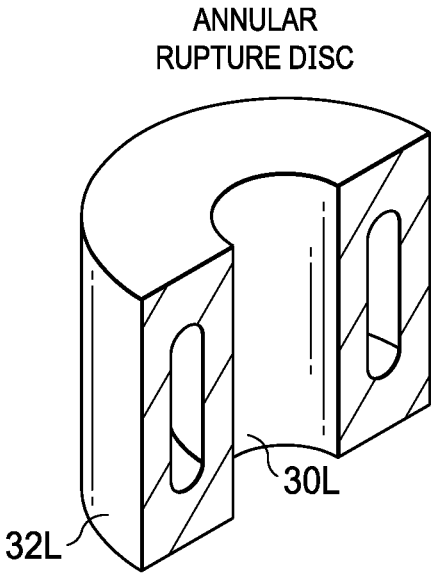

In FIGS. 2G and 2H, rupture layers 30*g* and 30*h* are defined by patterns of deformations, as compared to that of housings 32*g* and 32*h*, that create stress concentrations. The patterns of deformations are defined as a multitude of at least one of differing levels of thickness and shapes. For example, rupture layer 30*g* can include a thickness level that is less than that of a thickness of housing 32*g* or it can include different thickness levels that are less than that of the thickness of housing 32*g*. Furthermore, the pattern of rupture layer 30*g* can include shapes similar to that of FIGS. 2C and 2E. In FIG. 2I, the design is similar to that of FIG. 2C with the exception that rupture layer 30*i* is formed with a different type of stress concentration that can cause the rupture layer 30*i* to rupture in response to force applied at a different pressure or pressure range. In FIG. 2J, a pincher is formed in housing 32J to cause rupture layer 30*j* to burst in a certain way. In FIG. 2K, rupture layer 30*k* is formed to include a box or rectangular shaped impression where sections of the impression are formed to have different levels of thickness to each other and housing 32K. Again, this is to allow the barrier device 26 to rupture in a certain way or configuration. In FIG. 2L, the barrier device 26 includes housing 32*l* and rupture layer 30*l* that are designed and formed in the shape of an outer casing and an inner tube. The housing 32*l* has a select thickness and rupture layer 30*l*, also of a select thickness, is formed along the ID wall, as illustrated. The rupture layer 30*l* could rupture in or out and expose new flow paths. For example, a flow path could be formed inside of the wall thickness that does not fluidly communicate with the ID of the tubing prior to this rupture section rupturing. This single rupture section can feed a single or multiple integral flow paths.

In any of the aforementioned embodiments, the composition of the material, i.e. metallurgy, for a rupture surface, e.g. 30*a*, can be consistent and continuous and the metallurgy for the associated housing 32*b*, however, can change. For example, welding energy used in this additive manufacturing process can be varied so that the rupture surface 30*a* has a lower strain to failure than the housing 30*b*. The welding energy can be varied by adjusting the speed of the laser, the energy of the laser, the spot size of the laser, the number of passes by the laser, as well as other parameters of the printing process. Adjusting the manufacturing parameters is a process that is readily accomplished within the additive manufacturing process but would be exceedingly difficult to achieve with other manufacturing processes. In one case, the manufacturing parameters are changed so that the porosity of the rupture surface is increased and increased porosity is correlated with reduced strain to failure in some metals. In another example, the manufacturing parameters are changed so that the powder grains are poorly bonded together so that the tensile strength of the part is reduced. In another example, the manufacturing parameters are changed so that the grain size of the metal is adjusted. The changes to the metallurgy can be across the entire surface of the rupture surface (e.g. 30*a*) or it can be along sections of the rupture surface such as in circumferential or radial patterns (such as those in FIGS. 2G and 2H).

Figure 3:
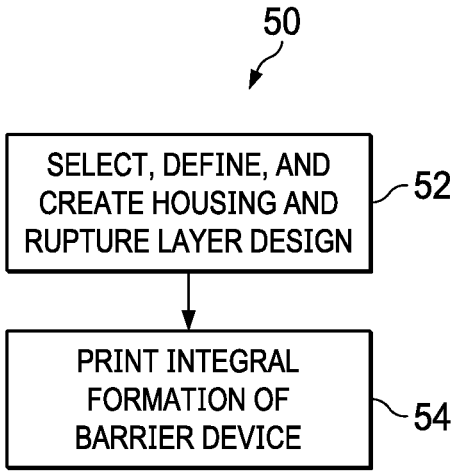
FIG. 3 is an illustration of a block diagram for an algorithm to control a 3D printer to create the integrally formed housing and rupture layer; in accordance with certain example embodiments.

Referring now to FIG. 3, illustrated is a block diagram for a computer algorithm for controlling a 3D printer, according to certain example embodiments, denoted generally as 50. A housing and rupture layer design along with manufacturing parameters can be selected and defined to create a specific manufacturing process, block 52. For example, a user can select and/or define a multitude of designs and select and/or define manufacturing parameters for the specific manufacturing process. Designs/definitions can include configurations, shapes, dimensions, materials, composition of such materials, and laser operations used in forming the barrier device 26. Once the design is created, the algorithm 50 causes a 3D printer to integrally form the housing and rupture layer according to the housing and rupture layer design.

Figure 4:
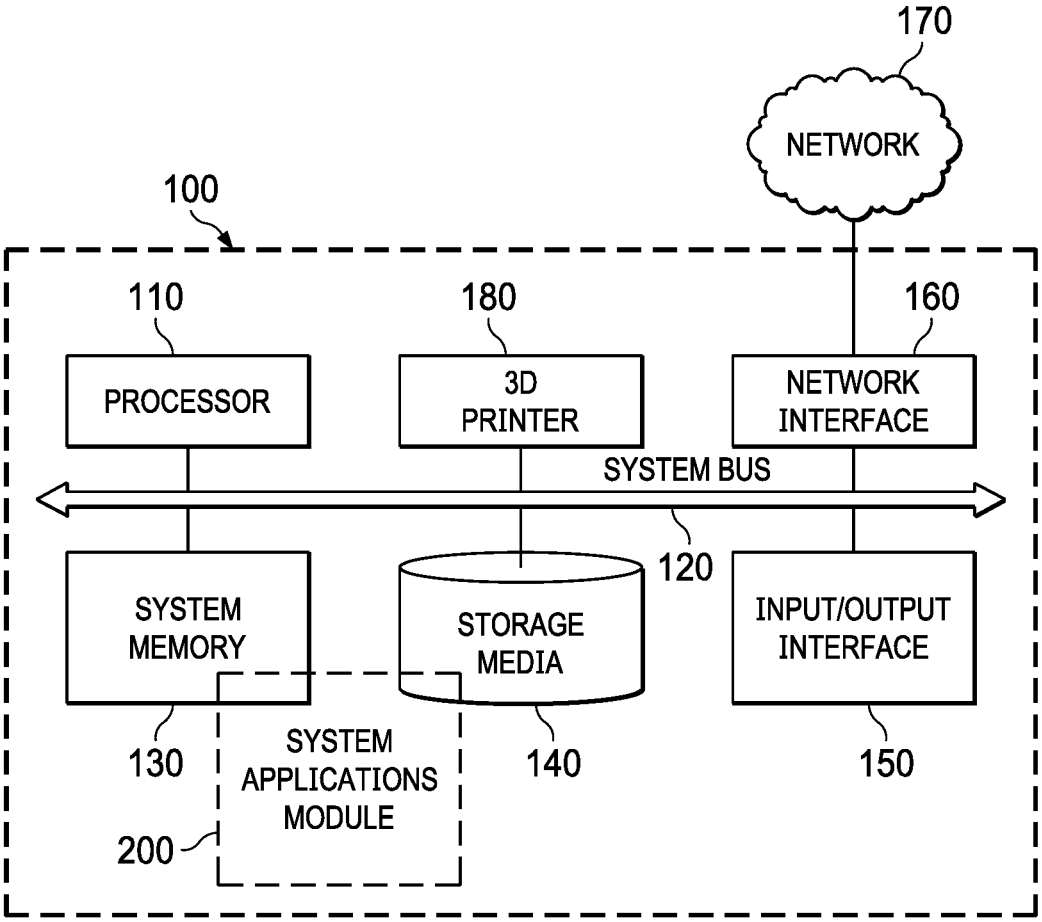
FIG. 4 is an illustration of a computing machine and system applications module, in accordance with example embodiments.

Referring now to FIG. 4, illustrated is a computing machine 100 and a system applications module 200, in accordance with example embodiments. The computing machine 100 can correspond to any of the various computers, mobile devices, laptop computers, servers, embedded systems, or computing systems presented herein. The module 200 can comprise one or more hardware or software elements, e.g. other OS application and user and kernel space applications, designed to facilitate the computing machine 100 in performing the various methods and processing functions presented herein. The computing machine 100 can include various internal or attached components such as a processor 110, system bus 120, system memory 130, storage media 140, input/output interface 150, and a network interface 160 for communicating with a network 170, e.g. a loopback, local network, wide-area network, cellular/GPS, Bluetooth, WIFI, and WIMAX. The computing machine 100 further includes a 3D printer for processing commands to create barrier devices 26 using a laser melting process.

The computing machine 100 can be implemented as a conventional computer system, an embedded controller, a laptop, a server, a mobile device, a smartphone, a wearable computer, a customized machine, any other hardware platform, or any combination or multiplicity thereof. The computing machine 100 and associated logic and modules can be a distributed system configured to function using multiple computing machines interconnected via a data network and/or bus system.

The processor 110 can be designed to execute code instructions in order to perform the operations and functionality described herein, manage request flow and address mappings, and to perform calculations and generate commands. The processor 110 can be configured to monitor and control the operation of the components in the computing machines. The processor 110 can be a general purpose processor, a processor core, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 110 can be a single processing unit, multiple processing units, a single processing core, multiple processing cores, special purpose processing cores, co-processors, or any combination thereof. According to certain embodiments, the processor 110 along with other components of the computing machine 100 can be a software based or hardware based virtualized computing machine executing within one or more other computing machines.

The system memory 130 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 130 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 130. The system memory 130 can be implemented using a single memory module or multiple memory modules. While the system memory 130 is depicted as being part of the computing machine, one skilled in the art will recognize that the system memory 130 can be separate from the computing machine 100 without departing from the scope of the subject technology. It should also be appreciated that the system memory 130 can include, or operate in conjunction with, a non-volatile storage device such as the storage media 140.

The storage media 140 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 140 can store one or more operating systems, application programs and program modules, data, or any other information. The storage media 140 can be part of, or connected to, the computing machine. The storage media 140 can also be part of one or more other computing machines that are in communication with the computing machine such as servers, database servers, cloud storage, network attached storage, and so forth.

The applications module 200, which includes algorithm 50, can comprise one or more hardware or software elements configured to facilitate the computing machine with performing the various methods and processing functions presented herein. The applications module 200 and other OS application modules can include one or more algorithms or sequences of instructions stored as software or firmware in association with the system memory 130, the storage media 140 or both. The storage media 140 can therefore represent examples of machine or computer readable media on which instructions or code can be stored for execution by the processor 110. Machine or computer readable media can generally refer to any medium or media used to provide instructions to the processor 110. Such machine or computer readable media associated with the applications module 200 and other OS application modules can comprise a computer software product. It should be appreciated that a computer software product comprising the applications module 200 and other OS application modules can also be associated with one or more processes or methods for delivering the applications module 200 and other OS application modules to the computing machine via a network, any signal-bearing medium, or any other communication or delivery technology. The applications module 200 and other OS application modules can also comprise hardware circuits or information for configuring hardware circuits such as microcode or configuration information for an FPGA or other PLD. In one exemplary embodiment, applications module 200 and other OS application modules can include algorithms capable of performing the functional operations described by the flow charts and computer systems presented herein.

The input/output ("I/O") interface 150 can be configured to couple to one or more external devices, to receive data from the one or more external devices, and to send data to the one or more external devices. Such external devices along with the various internal devices can also be known as peripheral devices. The I/O interface 150 can include both electrical and physical connections for coupling the various peripheral devices to the computing machine or the processor 110. The I/O interface 150 can be configured to communicate data, addresses, and control signals between the peripheral devices, the computing machine, or the processor 110. The I/O interface 150 can be configured to implement any standard interface, such as small computer system interface ("SCSI"), serial-attached SCSI ("SAS"), fiber channel, peripheral component interconnect ("PCI"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 150 can be configured to implement only one interface or bus technology. Alternatively, the I/O interface 150 can be configured to implement multiple interfaces or bus technologies. The I/O interface 150 can be configured as part of, all of, or to operate in conjunction with, the system bus 120. The I/O interface 150 can include one or more buffers for buffering transmissions between one or more external devices, internal devices, the computing machine, or the processor 120.

The I/O interface 120 can couple the computing machine to various input devices including mice, touch-screens, scanners, electronic digitizers, sensors, receivers, touchpads, trackballs, cameras, microphones, keyboards, any other pointing devices, or any combinations thereof. The I/O interface 120 can couple the computing machine to various output devices including video displays, speakers, printers, projectors, tactile feedback devices, automation control, robotic components, actuators, motors, fans, solenoids, valves, pumps, transmitters, signal emitters, lights, and so forth.

The computing machine 100 can operate in a networked environment using logical connections through the NIC 160 to one or more other systems or computing machines across a network. The network can include wide area networks (WAN), local area networks (LAN), intranets, the Internet, wireless access networks, wired networks, mobile networks, telephone networks, optical networks, or combinations thereof. The network can be packet switched, circuit switched, of any topology, and can use any communication protocol. Communication links within the network can involve various digital or an analog communication media such as fiber optic cables, free-space optics, waveguides, electrical conductors, wireless links, antennas, radio-frequency communications, and so forth.

The processor 110 can be connected to the other elements of the computing machine or the various peripherals discussed herein through the system bus 120. It should be appreciated that the system bus 120 can be within the processor 110, outside the processor 110, or both. According to some embodiments, any of the processors 110, the other elements of the computing machine, or the various peripherals discussed herein can be integrated into a single device such as a system on chip ("SOC"), system on package ("SOP"), or ASIC device.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions unless otherwise disclosed for an exemplary embodiment. Further, a skilled programmer would be able to write such a computer program to implement an embodiment of the disclosed embodiments based on the appended flow charts, algorithms and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a downhole barrier device for use in wellbore operations, the device comprising: a housing having a design; and a rupture layer formed with the housing and having another design;

Clause 2, the downhole barrier device of clause 1 wherein the housing and rupture layer are integrally formed using a laser melting process;

Clause 3, the downhole barrier device of clause 2 wherein the housing and rupture layer are formed having a density greater than 98 percent;

Clause 4, the downhole barrier device of clause 2 wherein the laser melting process is performed using a 3D printing process;

Clause 5, the downhole barrier device of clause 2 wherein the other design is selected from a plurality of designs;

Clause 6, the downhole barrier device of clause 5 where the plurality of designs includes at least two of: at least one fabricated stress concentration; at least one pattern of thickness less that of a thickness of the design; a sealing layer, a support layer, and a flow hole; and at least one shape selectable selected from a disc shape, a pinched shape, a folded shape, and a curved shape;

Clause 7, the downhole barrier device of clause 1 wherein the downhole barrier device is formed using a metal selected from a plurality of metals;

Clause 8, the downhole barrier device of clause 7 wherein the metal is selected based on operational use of the downhole barrier device;

Clause 9, a method of manufacturing a downhole barrier device for use in wellbore operations, the method comprising: creating a housing design; creating a rupture layer design; and creating a formation of the downhole barrier device wherein a rupture layer is formed with a housing using the housing design and the rupture layer design;

Clause 10, the method of clause 9 wherein the housing and rupture layer are integrally formed using a laser melting process;

Clause 11, the method of clause 10 wherein the housing and rupture layer are designed and formed having a density greater than 98 percent;

Clause 12, the method of clause 10 wherein the laser melting process is performed using a 3D printing process;

Clause 13, the method of clause 9 where creating the formation using the housing design and the rupture layer design includes creating at least two of: a stress concentration; at least one pattern of thickness for the rupture layer, wherein the at least one pattern of thickness is less that of a thickness of the housing; a sealing layer, a support layer, and a flow hole; and at least one shape selectable selected from a disc shape, a pinched shape, a folded shape, and a curved shape;

Clause 14, The method of clause 9 wherein the downhole barrier device is formed using a metal selected from a plurality of metals;

Clause 15, the downhole barrier device of clause 14 wherein the metal is selected based on operational use of the downhole barrier device;

Clause 16, a method of using a downhole barrier device to activate a downhole tool, the method comprising: setting an integrally formed barrier casing and rupture layer in a wellbore; causing the rupture layer to rupture in response to applying force to the rupture layer;

Clause 17, the method of clause 16 wherein the barrier casing and rupture layer are integrally formed using a laser melting process;

Clause 18, the method of clause 16 wherein the laser melting process is performed using a 3D printing process;

Clause 19, the method of clause 16 wherein the downhole barrier device is formed using a metal selected from a plurality of metals and selected based on the operational use of the downhole barrier device; and Clause 20, the method of clause 16 wherein the downhole tool is one of a packer and a shift sleeve.

What is claimed is:

1. A downhole barrier device for use in wellbore operations, the device comprising:

a housing having a design; and a rupture layer formed within the housing and having another design; wherein the housing has a first side comprising a hole adjacent to the rupture layer; wherein the first side of the housing and the adjacent rupture layer are configured to rupture at a lower pressure than the opposing side of the housing, and further wherein the housing and the rupture layer are integrally formed.

2. The downhole barrier device of claim 1 wherein the housing and rupture layer are integrally formed using a laser melting process.

3. The downhole barrier device of claim 2 wherein the housing and rupture layer are formed having a porosity less than 2%.

4. The downhole barrier device of claim 2 wherein the laser melting process is performed using a 3D printing process.

5. The downhole barrier device of claim 2 wherein the other design is selected from a plurality of designs.

6. The downhole barrier device of claim 5 where the plurality of designs includes at least two of:

at least one fabricated stress concentration;

at least one pattern of thickness less that of a thickness of the design;

a sealing layer, a support layer, and a flow hole; and at least one shape selectable selected from a disc shape, a pinched shape, a folded shape, and a curved shape.

7. The downhole barrier device of claim 1 wherein the downhole barrier device is formed using a metal selected from a plurality of metals.

8. The downhole barrier device of claim 7 wherein the metal is selected based on operational use of the downhole barrier device.

9. A method of manufacturing a downhole barrier device for use in wellbore operations, the method comprising:

creating a housing design;

creating a rupture layer design; and creating a formation of the downhole barrier device wherein a rupture layer is formed within a housing using the housing design and the rupture layer design; wherein the housing has a first side comprising a hole adjacent to the rupture layer;

wherein the first side of the housing and the adjacent rupture layer rupture at a lower pressure than the opposing side of the housing, and further wherein the housing and the rupture layer are integrally formed.

10. The method of claim 9 wherein the housing and rupture layer are integrally formed using a laser melting process.

11. The method of claim 10 wherein the housing and rupture layer are designed and formed having a porosity less than 2%.

12. The method of claim 10 wherein the laser melting process is performed using a 3D printing process.

13. The method of claim 9 where creating the formation using the housing design and the rupture layer design includes creating at least two of:

a stress concentration;

at least one pattern of thickness for the rupture layer, wherein the at least one pattern of thickness is less that of a thickness of the housing;

a sealing layer, a support layer, and a flow hole; and at least one shape selectable selected from a disc shape, a pinched shape, a folded shape, and a curved shape.

14. The method of claim 9 wherein the downhole barrier device is formed using a metal selected from a plurality of metals.

15. The downhole barrier device of claim 14 wherein the metal is selected based on operational use of the downhole barrier device.

16. A method of using a downhole barrier device to activate a downhole tool, the method comprising:

setting an integrally formed barrier casing and rupture layer in a wellbore; wherein the barrier casing has a first side comprising a hole adjacent to the rupture layer; wherein the first side of the barrier casing and the adjacent rupture layer rupture at a lower pressure than the opposing side of the barrier casing;

causing the rupture layer to rupture in response to applying force to the rupture layer.

17. The method of claim 16 wherein the barrier casing and rupture layer are integrally formed using a laser melting process.

18. The method of claim 16 wherein the laser melting process is performed using a 3D printing process.

19. The method of claim 16 wherein the downhole barrier device is formed using a metal selected from a plurality of metals and selected based on the operational use of the downhole barrier device.

20. The method of claim 16 wherein the downhole tool is one of a packer and a shift sleeve.

* * * * *